US009208757B2

(12) United States Patent
Artino

(10) Patent No.: US 9,208,757 B2
(45) Date of Patent: Dec. 8, 2015

(54) TUNE STABILIZING DEVICE FOR A STRINGED INSTRUMENT

(71) Applicant: Anthony P. Artino, Hudson, OH (US)

(72) Inventor: Anthony P. Artino, Hudson, OH (US)

( * ) Notice: Subject to any disclaimer, the term of this patent is extended or adjusted under 35 U.S.C. 154(b) by 87 days.

(21) Appl. No.: 13/970,894

(22) Filed: Aug. 20, 2013

(65) Prior Publication Data

US 2014/0260890 A1 Sep. 18, 2014

Related U.S. Application Data

(60) Provisional application No. 61/783,102, filed on Mar. 14, 2013.

(51) Int. Cl.
*G10D 3/12* (2006.01)
*G10D 3/14* (2006.01)

(52) U.S. Cl.
CPC ..... *G10D 3/14* (2013.01)

(58) Field of Classification Search
CPC ..... G10D 3/14
USPC ..... 84/297 R
See application file for complete search history.

(56) References Cited

U.S. PATENT DOCUMENTS

| | | | | |
|---|---|---|---|---|
| 4,475,432 | A | 10/1984 | Stroh | |
| 4,574,678 | A | 3/1986 | Edwards | |
| 4,667,561 | A | 5/1987 | Storey et al. | |
| RE32,863 | E | 2/1989 | Edwards | |
| 4,878,413 | A * | 11/1989 | Steinberger | 84/314 N |
| 5,456,151 | A | 10/1995 | Enserink | |
| 5,932,822 | A | 8/1999 | Bernstein | |
| 5,986,192 | A | 11/1999 | Wingfield et al. | |
| 6,700,043 | B2 * | 3/2004 | Hirayama | 84/314 N |
| 6,703,546 | B1 | 3/2004 | Wilson | |
| 6,806,411 | B1 * | 10/2004 | Allen | 84/454 |
| 6,812,389 | B2 | 11/2004 | Trooien | |
| 6,933,430 | B2 * | 8/2005 | Oskorep | 84/322 |
| 7,145,065 | B2 | 12/2006 | Geier | |
| 7,427,703 | B2 | 9/2008 | Geier | |
| D646,710 | S | 10/2011 | Chaput | |

FOREIGN PATENT DOCUMENTS

| | | | |
|---|---|---|---|
| EP | 0249464 | A2 | 12/1987 |
| EP | 0626673 | A2 | 11/1994 |
| WO | WO9006571 | A1 | 6/1990 |

OTHER PUBLICATIONS

Reynald Chaput, www.sta-tuned.com, String Lock for Electric Guitars, 2013.

(Continued)

*Primary Examiner* — Jianchun Qin
(74) *Attorney, Agent, or Firm* — George W. Moxon, II; Brian Harrod

(57) ABSTRACT

A tune stabilizing device for a stringed instrument, comprising a string clamping means comprising a floating base plate and at least one clamping block adapted to cooperatively engage and releasably secure a plurality of instrument strings, and a fine-tuning means, which extends from, and is integral with, said clamping means, and has a plurality of fine tuning screws in one-to-one correspondence with said instrument strings, whereby turning one of said screws presses on one of said strings, altering the tune of the string.

13 Claims, 8 Drawing Sheets

(56) References Cited

OTHER PUBLICATIONS

Reynald Chaput, String Lock for Jazz Style Electric Guitars, http://www.sta-tuned.com/electric-guitar-systems/j-style-system.html, Oct. 2011.

Fender USA, Fine Tune Lock Nut for Stratocaster, https://reverb.com/item/512244-rare-1980s-fender-usa-fine-tune-lock-nut-locking-tuners-for-stratocaster, 1984.

* cited by examiner

TUNE STABILIZING DEVICE FOR A STRINGED INSTRUMENT

I. BACKGROUND OF THE INVENTION

A. Field of Invention

Some embodiments of the present invention may generally relate to stabilizing the tension in precisely tensioned wires.

B. Description of the Related Art

It is known to have precisely tensioned wires in a wide variety of contexts including musical instruments such as guitars. With particular regard to electric guitars, it is known to equip such an instrument with a tremolo system allowing the user to radically and quickly fluctuate the tension in the strings. Furthermore, such variation is known to cause the string tension to change even after the tremolo is relaxed, i.e. the instrument goes out of tune. One component of this change in tension is due to the strings hanging up on the nut of the guitar. It is known to use lubricants on the nut to prevent such hang ups; however, this is also known to be an imperfect solution which merely mitigates rather than eliminates the tendency to go out of tune. It also tends to be a messy and short-lived solution.

Clamps have been installed in guitars which typically are bolted to the instrument replacing the nut. This can be effective, but it requires radically and irreversibly modifying the instrument. This is undesirable to many musicians, and may be unacceptable in the case of particularly valuable or collectible instruments. Even when a clamp is installed, the user is inconvenienced because he must compensate for the fact that the string tension is affected by the clamping process. Therefore, in order to maintain perfect tuning pitch, the musician must install a tremolo system which houses a fine-tuner system. Similar to installing a clamp, it may not be desirable to install a new tremolo system and may require milling or otherwise irreversibly modifying the instrument.

What is needed is a device which helps to prevent an instrument from going out of tune, while not requiring modification of the instrument. Some embodiments of the present invention may provide one or more benefits or advantages over the prior art.

II. SUMMARY OF THE INVENTION

Some embodiments may relate to a wire tension stabilizing device, comprising: a floating base plate having at least one compression face, the floating base plate including at least one female thread, the floating base plate further comprising an abutment surface running along an edge of the floating base plate and adapted to abut an arbitrary anchor point; at least one clamping block having at least one compression face adapted to mate with the at least one compression face of the floating base plate, the clamping block including at least one unthreaded through-hole adapted to receive a screw therethrough, wherein the compression faces of the at least one clamping block and the floating base plate are adapted to cooperatively receive a plurality of tensioned wires between cooperating compression faces in an orientation generally parallel to the cooperating compression faces, the plurality of tensioned wires being work-pieces; and at least one clamping screw adapted to be cooperatively received by one of the at least one female threads of the floating base plate and one of the at least one unthreaded through-holes of the at least one clamping block so as to develop a compressive force between the compression face of the floating base plate and the compression face of the at least one clamping block, the compressive force being sufficient to fix the position of at least one of the plurality of tensioned wires relative to the floating base plate and the at least one clamping block.

According to some embodiments the at least one clamping block is attached to the at least one clamping screw with an e-clip which seats in a notch in a shaft of the clamping screw so that the at least one clamping block moves away from the floating base plate as the clamping screw is loosened.

According to some embodiments the at least one clamping block comprises three clamping blocks each adapted to clamp two tensioned wires.

According to some embodiments the compression face of the floating base plate defines a recessed clamp seat at least partially surrounded by a perimeter wall, the clamp seat being adapted to receive the at least one compression face of the at least one clamping block, and the perimeter wall having a plurality of apertures in a clamping side of the perimeter wall and a plurality of cooperating apertures in a fine tuning side of the perimeter wall, the clamping side apertures and fine tuning side apertures cooperating to receive the plurality of tensioned wires therethrough in a straight line.

According to some embodiments the compression face of the floating base plate further comprises a plurality of dividing walls which cooperate to define discrete clamp seats each adapted to receive one clamping block.

According to some embodiments the floating base plate further extends from an upper edge of the perimeter wall to define a fine-tuner plate, the fine-tuner plate including a plurality of female threaded apertures, each being adapted to receive a fine-tuner screw, wherein the female threaded apertures and the fine-tuner screws cooperate to engage the plurality of tensioned wires side-on in a tension-adjusting relation effected by turning the screws.

Some embodiments may further comprise a fine tuning side wall extending from a fine tuning side edge of the fine-tuner plate, the fine tuning side wall defining a plurality of apertures for allowing each of the plurality of tensioned wires to pass therethrough.

Some embodiments may further comprise at least one magnet disposed between the fine-tuner screws and the at least one clamping screw, wherein the magnet is adapted to anchor a tool to the device.

According to some embodiments the tool is selected from one or more of an Allen wrench, a screw driver, or a nut driver.

According to some embodiments the floating base plate defines an arc tracking the spatial arrangement of the tensioned wires.

Some embodiments may relate to a wire tension stabilizing device, comprising: a floating base plate having a planar compression face, the floating base plate including at least one female thread adapted to receive a screw, the floating base plate further comprising an abutment surface running along an edge of the floating base plate and adapted to abut an arbitrary anchor point; a fine-tuner plate defined by the floating base plate extending beyond the compression face of the floating base plate to define a surface, the fine-tuner plate including a plurality of female threaded apertures, each being adapted to receive a fine-tuner screw, wherein the female threaded apertures and the fine-tuner screws cooperate to engage the plurality of tensioned wires side-on in a tension-adjusting relation effected by turning the screws; at least one clamping block having at least one compression face adapted to mate with the at least one compression face of the floating base plate, the clamping block including at least one unthreaded through-hole adapted to receive a screw therethrough, wherein the compression faces of the at least one clamping block and the floating base plate are adapted to cooperatively receive a plurality of tensioned wires between cooperating compression faces in an orientation generally parallel to the cooperating compression faces, the plurality of tensioned wires being work-pieces; at least one clamping screw adapted to be cooperatively received by one of the at least one female threads of the floating base plate and one of the at least one unthreaded through-holes of the at least one clamping block so as to develop a compressive force between the compression face of the floating base plate and the compression face of the at least one clamping block, the compressive force being sufficient to fix the position of at least one of the plurality of tensioned wires relative to the floating base plate and the at least one clamping block; and an e-clip attaching the at least one clamping block to the at least one clamping screw, the e-clip seating in a notch in a shaft of the clamping screw so that the at least one clamping block moves away from the floating base plate as the clamping screw is loosened.

Some embodiments may relate to a wire tension stabilizing device, comprising: a floating base plate having at least one compression face, the floating base plate including at least one female thread, the floating base plate further comprising an abutment surface running along an edge of the floating base plate and adapted to abut an arbitrary anchor point; at least one clamping block defining a U-shape wherein each leg of the U-shaped clamping block defines a compression face, the pair of compression faces of the U-shaped clamping block being adapted to mate a compression face of the floating base plate having a complementary relief, the clamping block including at least one unthreaded through-hole adapted to receive a screw therethrough, wherein the compression faces of the at least one clamping block and the floating base plate are adapted to cooperatively receive a plurality of tensioned wires between cooperating compression faces in an orientation generally parallel to the cooperating compression faces, the plurality of tensioned wires being work-pieces; at least one clamping screw adapted to be cooperatively received by one of the at least one female threads of the floating base plate and one of the at least one unthreaded through-holes of the at least one clamping block so as to develop a compressive force between the compression face of the floating base plate and the compression face of the at least one clamping block, the compressive force being sufficient to fix the position of at least one of the plurality of tensioned wires relative to the floating base plate and the at least one clamping block; and an e-clip attaching the at least one clamping block to the at least one clamping screw, the e-clip seating in a notch in a shaft of the clamping screw so that the at least one clamping block moves away from the floating base plate as the clamping screw is loosened.

According to some embodiments the at least one compression face of the floating baseplate and/or the compression faces of the at least one clamping block include knurling and/or texturing.

Some embodiments may further comprise at least one shim mounted to an underside of the fine tuner plate and adapted to be disposed between an end of at least one fine tuner screw and a string with which the fine tuner screw is adapted to engage in a fine tuning relation.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1A:
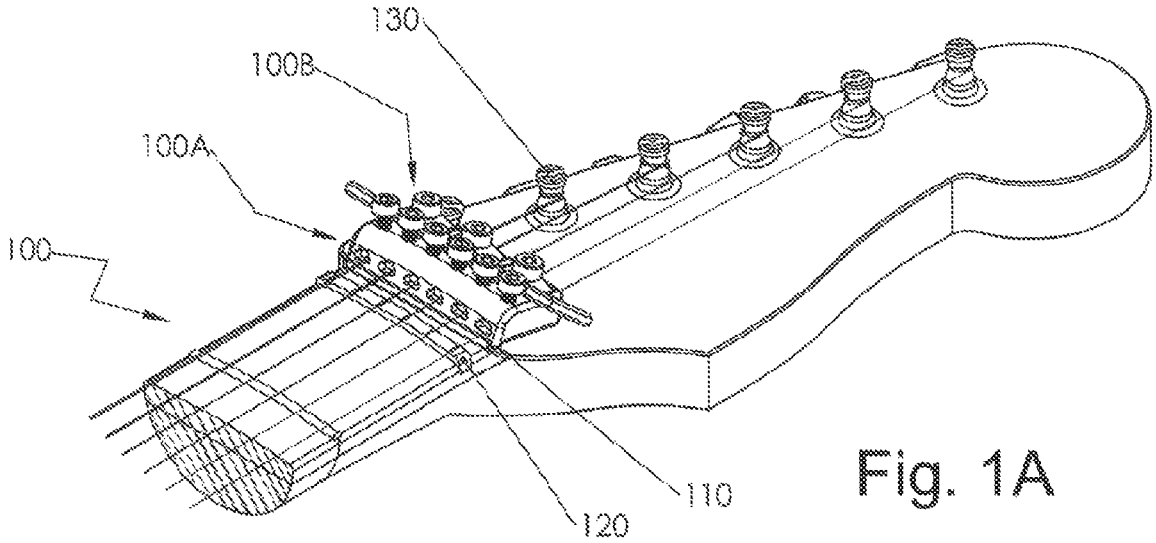
FIG. 1A is a perspective view of an embodiment mounted against the leading edge of the fret board of a guitar.

Embodiments may comprise a device for stabilizing the tension of one or more precisely tensioned wires. According to some embodiments, such a device may include a base plate and one or more clamping blocks mountable thereto. The clamping blocks may be adapted to develop a clamping force between a surface of the clamping blocks and a surface of the base plate such that one or more tensioned wires may be held between the clamping blocks and the base plate in a fixed relation. In this context, a fixed relation includes a lack of any relative motion between the tensioned wires, and the clamping blocks and base plate. Furthermore, an embodiment may be adapted to abut a predetermined anchor point so as to hold the portion of the tensioned wires in contact with the device in a fixed position relative to the anchor point. As used herein the term tensioned wires, wires, and strings may be used interchangeably.

Embodiments disclosed herein are largely described in terms of stringed musical instruments. However, one skilled in the art will appreciate that the invention is not limited to stringed musical instruments which represent only one of many applications. Embodiments of the invention may also find application in any technical area where wires must be maintained at a precise tension despite large or violent transient fluctuations in tension.

According to some embodiments a wire tension stabilizing device may include a base plate having a generally planar compression face. In this context, the term generally planar can include exactly planar surfaces, slightly arched surfaces, and/or knurled or textured surfaces. The base plate may be a floating base plate, meaning that the base plate may not be mounted to an object which fixes its position. For instance, in the context of a stringed musical instrument, a floating base plate may not be bolted or cemented to the instrument but rather may only make contact with, and/or abut, one or more predetermined instrument surfaces. Notwithstanding, an embodiment may be clamped to the strings of the stringed instrument and still be within the meaning of floating as used herein.

Further according to embodiments of the invention, a floating base plate may include one or more female threads, which may be adapted to receive a screw such as, without limitation, a machine screw or other suitably threaded screw. In general, such threads may be perpendicular to the compression face of the floating base plate; however, other embodiments may include threads disposed at an oblique angle without departing from the scope of the invention.

Floating base plates according to embodiments of the invention may include an abutment surface adapted to abut an arbitrary anchor point so as to hold the portion of the tensioned wires in contact with the device in a fixed position relative to the anchor point. An abutment surface may simply be a side of the floating base plate. However, in some embodiments, the abutment surface may be specially adapted to mate with particular anchor points. For instance, in the context of a guitar, a suitable anchor point may be the nut of the guitar or a leading edge of the fret board. In some guitar models, the nut may be about a quarter inch from the leading edge of the fret board, and the strings may be oriented so that the embodiment cannot slide between the strings and the fret board to contact the nut. In such instances, if the nut is the desired anchor point, then the abutment surface may be specially adapted to extend past the leading edge of the fret board. For example, a portion of the abutment surface may or may not abut the leading edge of the fret board, but a relatively thin extension thereof may extend past the leading edge of the fret board through the thin gap between the strings and fret board. Accordingly, the extension may abut the nut such that the nut bears all or most of the load imposed by tension in the wires. In some embodiments, this relatively thin extension of the abutment surface may comprise a unitary or permanently joined part of the floating base plate, or it may be an optional accessory or attachment.

According to some embodiments, a clamping block may have a planar compression face. Similar to the floating base plate, a planar compression face in this context may comprise an exactly planar surface, a slightly arched surface, and/or a knurled or textured surface. Notwithstanding, the compression face of the clamping block must mate with that of the floating base plate, and therefore must have a complementary shape. Suitable clamping blocks may include at least one unthreaded through-hole adapted to receive a screw, such as, without limitation, a machine screw or other suitably threaded screw permitting a smooth turning action and precise positioning of the screw. The unthreaded through-hole of the clamping block must be oriented to cooperate with the female threads of the floating base plate so that both may simultaneously receive the same screw. Together, the compression faces of the floating base plate and the clamping block cooperate to receive one or more tensioned wires in a clamping relation. As used herein the term clamping relation includes applying a compression force sufficient to fix the position of a work piece, such as tensioned wires, relative to the clamping block and floating base plate. Furthermore, as used herein, the term work piece means a thing upon which an embodiment acts and is separate and distinct from the embodiment.

In some embodiments, the compression face of the floating base plate may define a recessed clamp seat. The recessed compression face may be partially or completely surrounded by a perimeter wall within the boundaries of which clamping blocks may be received in a mating relation by the compression face of the floating base plate. According to some embodiments, the compression face may include one or more dividing walls which cooperate to divide the compression face into a plurality of discrete clamp seats each receiving one clamping block. In such embodiments, the dividing walls may function to align the clamping blocks according to a preferred orientation.

A perimeter wall may include a plurality of apertures on opposing sections of the perimeter wall, which cooperate to allow the tensioned wires to pass therethrough parallel to the compression face of the floating base plate. For instance, a first set of apertures may be defined in a first perimeter wall section, and a second set of corresponding apertures may be defined in a second perimeter wall section disposed on an opposing side of the compression face of the floating base plate. Accordingly, a single tensioned wired may pass through a pair of cooperating apertures in a straight line.

One skilled in the art will appreciate that the act of applying a clamping force to a set of precisely tensioned wires may change the tension in the wires. Accordingly, some embodiments may include a set of fine-tuners for adjusting wire tension after the embodiment has been installed. In one embodiment, a set of fine-tuners is defined by extending the base plate from an upper edge of a perimeter wall so as to define a generally planar surface comprising a fine-tuner plate oriented approximately parallel to the compression face of the floating base plate. The fine-tuner plate may include a plurality of female threaded apertures, each being adapted to receive a fine-tuner screw. Suitable screws may include, without limitation, machine screws or other precisely threaded screws permitting fine control over the position of the screw. Accordingly, the fine-tuner screws and female threaded apertures cooperate to contact and precisely deflect a tensioned wire underlying the fine-tuner plate.

An embodiment may further comprise an abutment wall extending from the fine-tuner plate at an edge opposing the perimeter wall. The wall may include a plurality of apertures, wherein the apertures may be sized, and their center points may be placed, so as to accommodate a predetermined range of wire spacings. In some embodiments, the apertures in the abutment wall may have a larger radius in a direction generally parallel to the fine-tuner plate, and a shorter radius in a direction generally perpendicular to the fine-tuner plate. Use of the term radius in this context is not intended to limit the shape of such apertures to circular. Rather the shape of such apertures may be any arbitrary shape including elliptical or generally oblong.

An abutment wall may include a bumper member which may function as a cushion between an embodiment and an abutment surface such as a fret board or nut of a musical instrument. Such a cushion may be desirable to protect the musical instrument from damage due to the embodiment pressing against, and/or moving relative to, the instrument. Suitable bumpers may be made from an elastomeric material such as a rubber, but in general the bumper material must be softer than the material against which it abuts so as to avoid damaging such material.

One skilled in the art will appreciate that in the context of musical instruments such as guitars, a set of tensioned wires may not lie in a flat plane but rather may lie in a curved or arched plane relative to a fret board or finger board. Accordingly, it may be desirable to have an embodiment wherein the floating base plate, the clamping block(s), their respective compression faces, and/or the apertures through which the tensioned wires pass, may be arranged in a corresponding arch which generally tracks the arch of the tensioned wires.

Figure 1B:
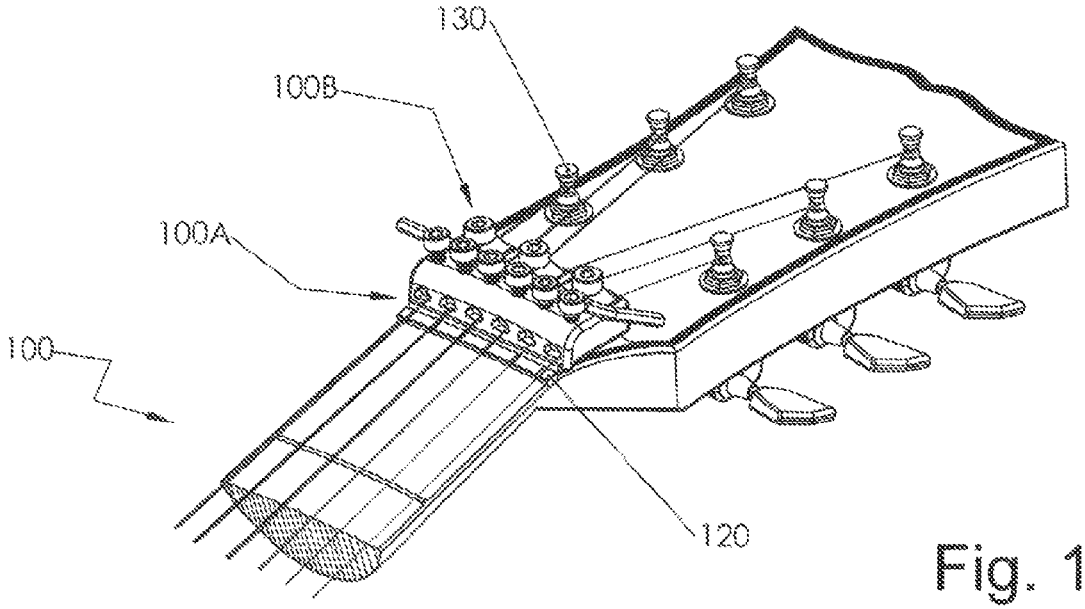
FIG. 1B is a perspective view of an embodiment mounted against the nut of a guitar.

Referring now to the drawings wherein the showings are for purposes of illustrating embodiments of the invention only and not for purposes of limiting the same, FIG. 1A is a perspective view of an embodiment 100 installed on a guitar. The embodiment 100 is shown abutting the leading edge 110 of the guitar's fret board, which offsets the embodiment 100 roughly a quarter inch from the nut 120 of the guitar. FIG. 1A also illustrates the proper orientation of the embodiment 100 when installed on a guitar. Namely, the fine tuners face the nut of the guitar and the clamps face the tuning posts 130 of the guitar. Accordingly, as used herein, the side of an embodiment facing the nut of a stringed instrument when properly installed is referred to as the fine tuner side 100A, and the opposing side which faces the tuners of the instrument is referred to as the clamping side 100B of the embodiment. FIG. 1B shows another installation of an embodiment 100 on a different style of guitar. In this case, the nut 120 of the guitar is at the leading edge of the fret board rather than being offset. Therefore, the embodiment 100 abuts the nut 120 directly.

Figure 2:
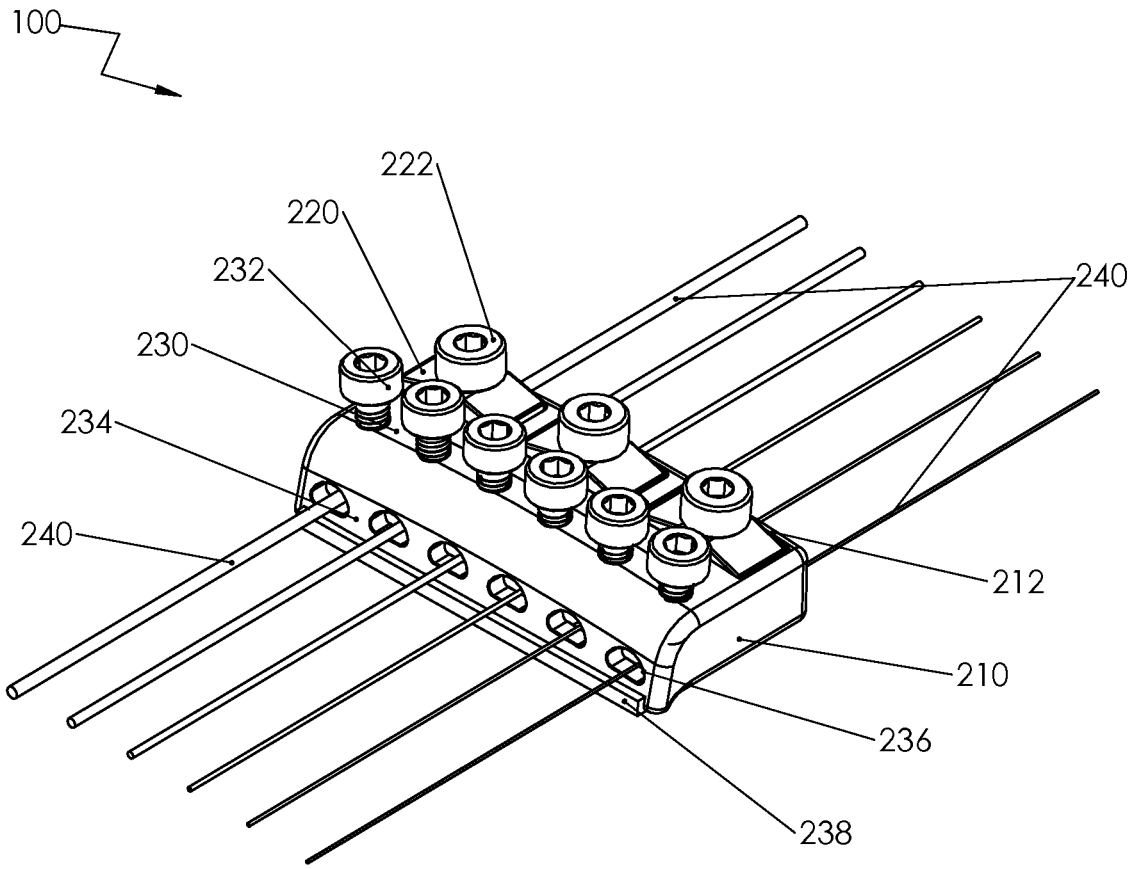
FIG. 2 is a perspective view drawing of an embodiment showing the side thereof which would face the nut of a stringed instrument.

FIG. 2 is a perspective view of an embodiment 100 installed on a set of six precisely tensioned wires 240 of a six-stringed musical instrument. The embodiment 100 includes a floating base plate 210 having three clamping blocks 220 for locking the embodiment 100 onto the wires 240. The clamping blocks 220 are seated in recessed compression faces defining clamp seats, which are surrounded by a perimeter wall 212. One skilled in the art will appreciate that the clamp seats need not be recessed, but that recession may provide certain advantages related to aligning clamping blocks 220 during installation. The embodiment 100 of FIG. 2 includes a set of three clamping blocks 220 which are each shown bolted to the floating base plate 210 with machine screws 222. Each clamping block 220 according to this particular embodiment 100 clamps two of the tensioned wires 240 between the compression faces of the clamping block 220 and the floating base plate 210.

Also shown in FIG. 2 are a set of six fine-tuner screws 232 engaging female threads formed in the fine tuner plate 230, wherein each fine-tuner screw 232 impinges upon a single tensioned wire 240 in a side-on relation so as to enable fine adjustments to the wires' tension. The embodiment further includes an abutment wall 234 having a bumper 238 at its lower edge. The bumper functions as a cushion between the embodiment 100 and a musical instrument to which it may be mounted, thereby protecting the instrument from scratches or other damage. The abutment wall 234 further includes a set of elongate apertures 236 through which the strings 240 pass. The specific size and configuration of the elongate apertures 236 may vary from one embodiment to the next, but in general they are sized to accommodate a variety of string spacings. Particularly, the elongate apertures 236 are positioned so that the embodiment 100 can be installed on a plurality of makes and models of guitar, each of which may position the strings slightly differently.

Figure 3:
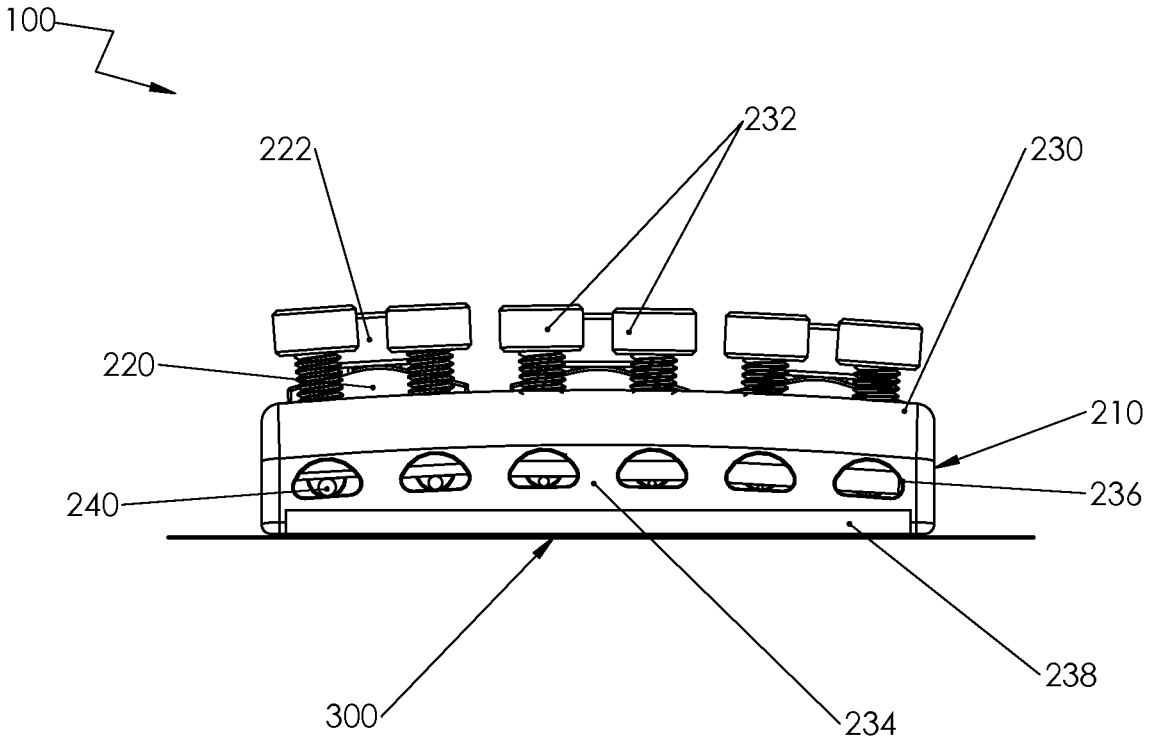
FIG. 3 is a fine tune side view of an embodiment showing the curvature of the embodiment.

FIG. 3 is fine tuner side view of an embodiment 100 illustrating the curvature 300 of the floating base plate 210. One skilled in the art will appreciate that such a curvature 300 may not be necessary but that it may be advantageous when an embodiment is to be installed on a stringed musical instrument where the strings lie in an arch rather than a flat plane. Thus, the curvature 300 of the floating base plate 210 may approximately track the curvature of the plane upon which the strings lie, so that a central axis of the apertures through which the strings 240 pass generally align with a central axis of the respective strings 240 which are threaded through said apertures. Embodiments which include a floating base plate 210 having a curvature 300 may also provide clamping blocks 220 and/or fine-tuner plates 230 with similar and/or cooperating curvatures.

Figure 4A:
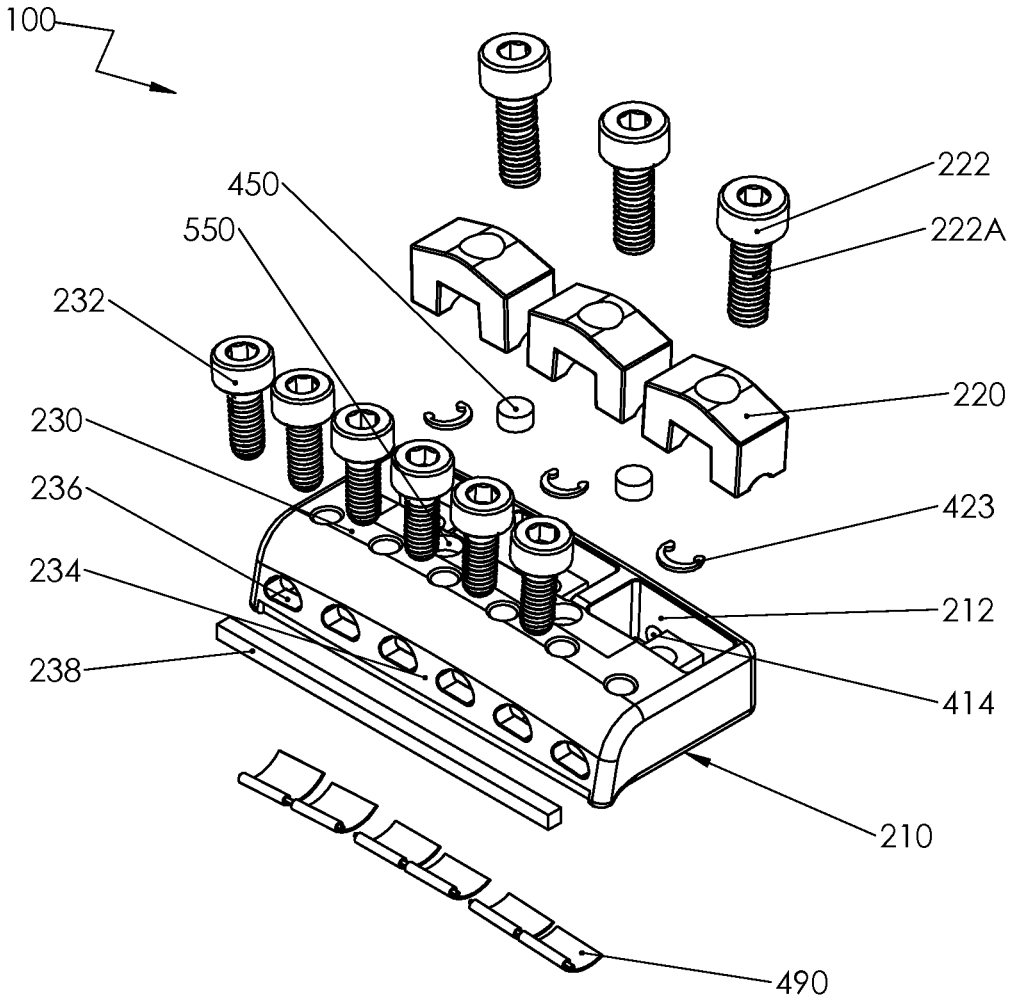
FIG. 4A is an exploded elevation view of an embodiment showing a recessed compression face.

FIG. 4A is an exploded elevation view of embodiment 100 showing the components thereof in greater detail. According to FIG. 4A the components of a clamping block assembly include a clamping block 220, a clamping screw 222 with a notch 222A which receives an e-clip 423. Thus, the clamping block 220 is retained on the clamping screw 222 by the e-clip 423 and moves in an upward direction as the clamping screw 222 is loosened. FIG. 4A also shows the placement of the magnets 450, which are seated in apertures 550 in the fine turner plate 230 located between the fine tuner screws 232 and the clamping screws 222. FIG. 4A also shows a set of six optional shims 490, which can be positioned between the ends of the fine tuner screws 232 and the strings 240 as a means of reducing wear on the strings 240 by the turning action of the fine tuner screws 232. Finally, FIG. 4A shows one of a first set of apertures 414 where strings 240 enter the embodiment 100.

Figure 4B:
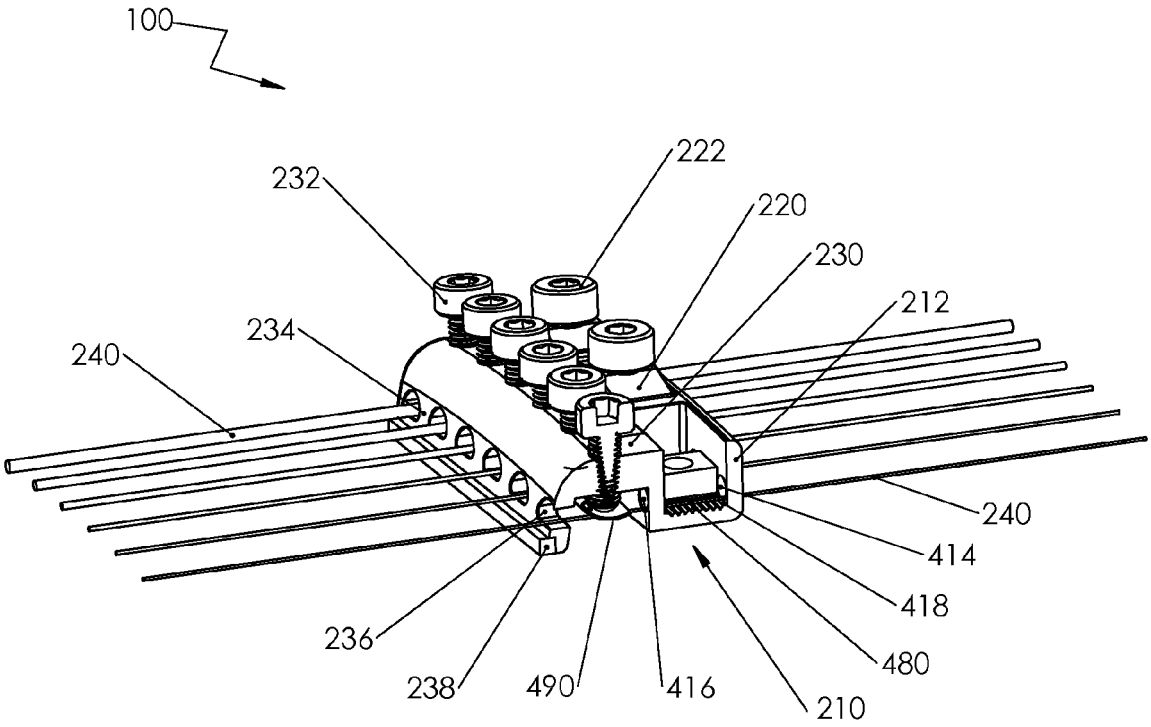
FIG. 4B is a cross sectional perspective side view of an embodiment showing the recessed compression face and fine tuners in more detail.

FIG. 4B shows the embodiment 100 in cross section from an alternate angle and illustrates a first set of apertures 414 in a first section of the perimeter wall 212, and a second set of cooperating apertures 416 disposed on an opposing second section of the perimeter wall 212. The first and second sets of apertures 414, 416 are aligned such that the six tensioned wires 240 pass through cooperating apertures in a straight line. Furthermore, this view illustrates the fact that the respective central axes of the apertures 236, 414, 416 are aligned. Thus, a string 240 may be threaded through the embodiment 100 in a straight line, i.e. without bends. Also shown in FIG. 4B is the clamp seat 418 which receives the compression face of the clamping block 220. Accordingly, this view clearly illustrates how a clamping block affixes an embodiment 100 to the strings 240. The particular clamp seat 418 shown in FIG. 4B includes optional texturing or knurling 480 to aid in gripping strings 240. FIG. 4B further illustrates the placement of optional shims 490. As shown, one edge of a shim 490 is attached to the underside of the embodiment 100 so as to position it between the end of a fine tuner screw 232 and a string 240.

Figure 5:
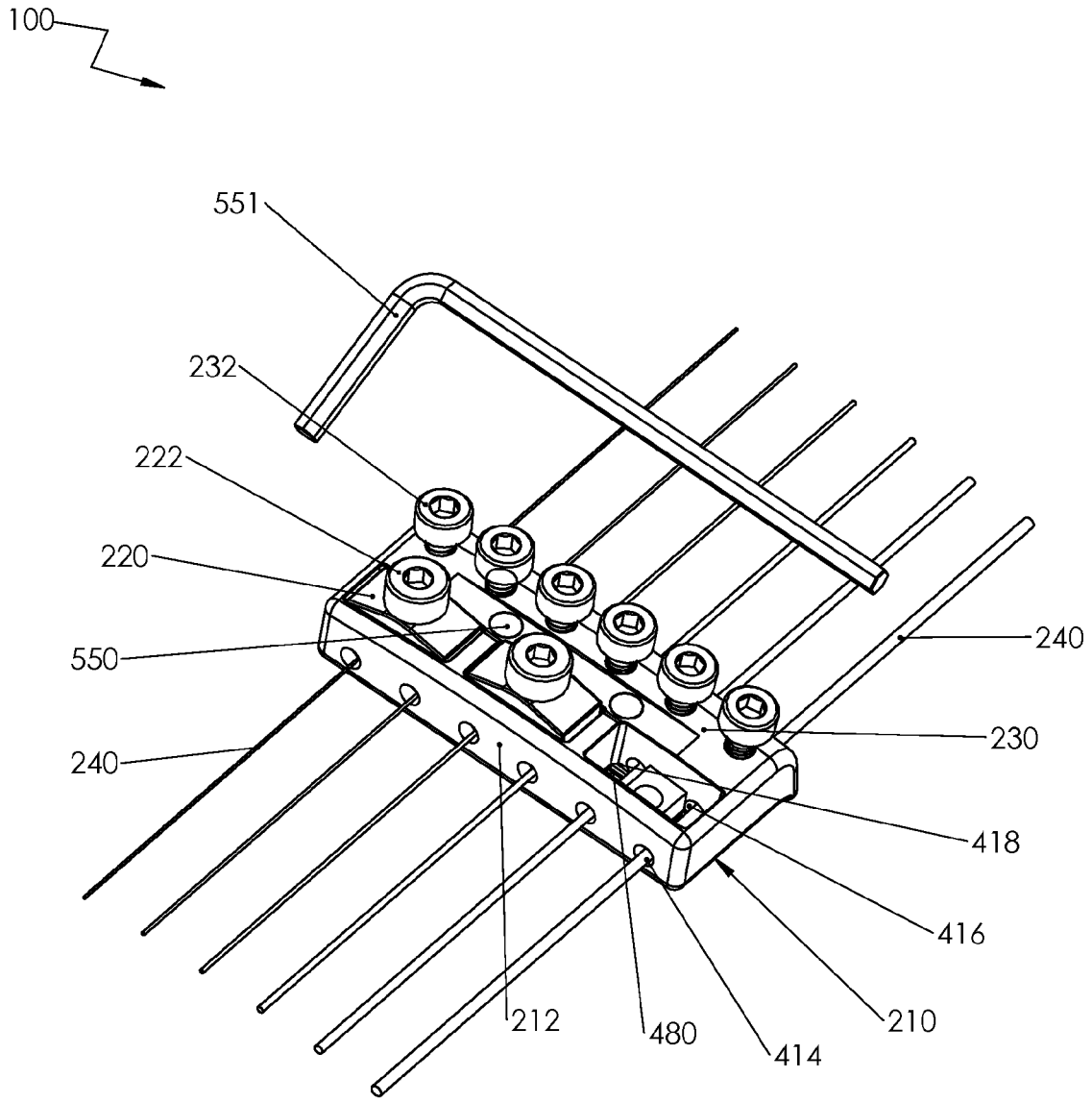
FIG. 5 is an elevation view of an embodiment showing placement of strings within the embodiment, and placement of a magnetically retained tool.

FIG. 5 is a perspective view of embodiment 100 showing the placement of magnets 550 in the fine tuner plate 230 and how the magnets 550 receive an Allen wrench 551 or similar tool. Thus, the magnets 550 hold the tool 551 between the fine tuners 232 and the clamping screws 222.

Figure 6:
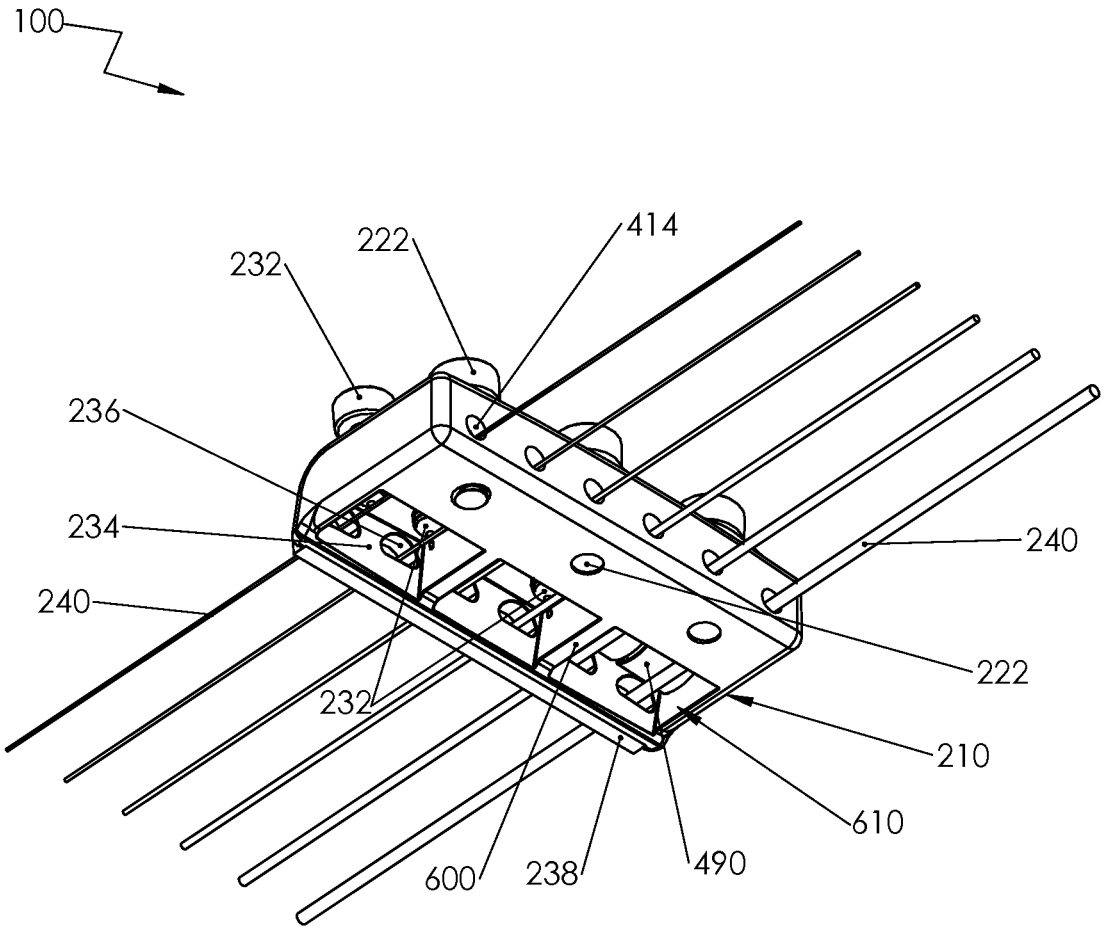
FIG. 6 is a perspective view from under an embodiment.

FIG. 6 is a perspective view of an underside of embodiment 100 which shows three fine-tuner cavities 610. The three fine-tuner cavities 610 are separated from each other by reinforcing walls 600. The reinforcing walls 600 provide added strength to the abutment wall 234 which may prevent it from flexing under load. Also visible are the posts of the fine-tuner screws 232 which are shown impinging the tensioned wires 240 side-on. Such side-on impingement results in a controlled deflection of a tensioned wire 240, thus finely adjusting its length and tension. Also visible in FIG. 6 are two optional shims 490. In many but not necessarily all embodiments, shims 490 would be provided for all six of the fine tuner screws 232. Here however, four shims 490 are left out for the purpose of illustration only.

Figure 7C:
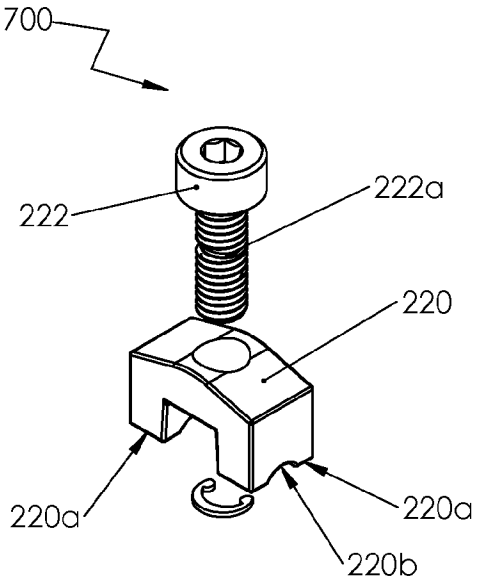
FIG. 7C is an exploded elevation view of a clamping block assembly.
Figure 7B:
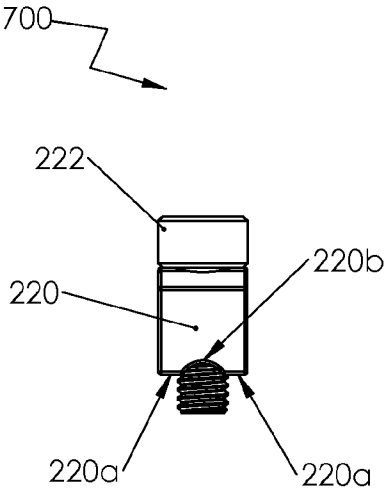
FIG. 7B is a side view of a clamping block assembly.
Figure 7A:
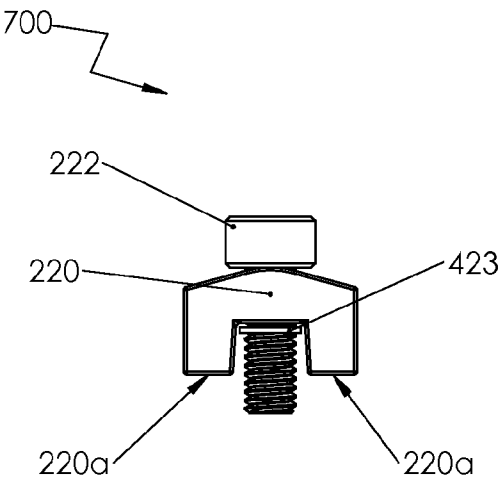
FIG. 7A is a front view of a clamping block assembly.

FIG. 7A illustrates a clamping block assembly 700 of an embodiment 100. A clamping block assembly 700 may include a clamping block 220 and a clamping screw 222. The clamping block 220 is retained on the clamping screw 222 using an e-clip 423. Thus, the clamping block 220 is free to rotate about the clamping screw 222, as the clamping block moves away from the floating base plate 210 when the clamping screw 222 is loosened. This may be especially convenient when threading strings 240 through the embodiment 100, and may obviate the need for removing the clamping block 220 from the embodiment 100 thereby decreasing the risk of losing parts or improper reassembly. Also shown in FIG. 7A is the U-shaped design of the clamping block 220. This U-shaped configuration allows for a complementary relief between the compression faces 220*a* of the clamping block 220 and the compression face 418 of the floating base plate 210, which allows the compression screw 222 to have a larger number of threads in contact with the female threads of the floating base plate 210, thus mitigating the potential for stripping threads.

FIG. 7B is a side view of the assembly 700 which further illustrates that each of the two compression faces 220*a* of the clamping block 220 include an arch 220*b*. One skilled in the art will appreciate that while an arch may not be critical, it may tend to provide better clamping characteristics than a simply flat compression face. FIG. 7C shows the clamping block assembly 700 in an exploded view and further illustrates the notch 222*a* in which the e-clip 423 is retained.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

I claim:

1. A tune stabilizing device for a stringed instrument, comprising:

a string clamping means comprising a floating base plate and at least one clamping block adapted to cooperatively engage and releasably secure a plurality of instrument strings, and a fine-tuning means, which extends from, and is integral with, said clamping means, and has a plurality of fine tuning screws in one-to-one correspondence with said instrument strings, whereby turning one of said screws presses on one of said strings, altering the tune of the string, wherein said at least one clamping block is attached to at least one clamping screw with a clip that seats in a notch in a shaft of the clamping screw so that said clamping block and screw are maintained as a unit and the clamping block moves away from the floating base plate as the clamping screw is loosened.

2. The device of claim 1, wherein said string clamping means capable of abutting a nut of a stringed instrument.

3. The tune stabilizing device of claim 1, wherein said floating base plate has a base compression face, and said clamping block has a block compression face adapted to mate with said base compression face, the clamping block including at least one unthreaded through-hole adapted to receive a screw therethrough, wherein the base and block compression faces are adapted to cooperatively engage a plurality of said instrument strings.

4. The device of claim 3, wherein said floating base plate includes a fine tuning plate having a plurality of generally oblong apertures that allow instrument strings to pass therethrough, and said apertures define an arc tracking the curvature or radius of the neck of the instrument.

5. The tune stabilizing device of claim 1, wherein the at least one clamping block comprises three clamping blocks each adapted to clamp two instrument strings.

6. The tune stabilizing device of claim 1, wherein said floating base plate is capable of being secured on the strings of a stringed instrument between the nut and the plurality of tuning pegs, and is suspended by said instrument strings such that it contacts no part of the instrument apart from the strings.

7. The device of claim 1, further including at least one magnet adapted to anchor a tool to the device.

8. The device of claim 7, wherein the at least one magnet is disposed between the fine-tuner screws and the string clamping means.

9. The device of claim 1, wherein said floating base plate further comprises a bumper that is capable of abutting a nut or leading edge of a fret board of a stringed instrument.

10. A tune stabilizing device for a stringed instrument having a nut, a fret or finger board, and a plurality of tuning pegs, comprising:

a floating base plate having a base compression face, and at least one female thread;

at least one clamping block having a block compression face adapted to mate with said base compression face, the clamping block including at least one unthreaded through-hole adapted to receive a screw therethrough, wherein the base and block compression faces are adapted to cooperatively engage a plurality of instrument strings;

at least one clamping screw adapted to be cooperatively received by one of the female threads of the floating base plate and one of the unthreaded through-holes of a clamping block so as to develop a compressive force between the base compression face and the block compression face, the compressive force being sufficient to fix the position of the tune-stabilizing device relative to the instrument strings; and a fine-tuner plate, having a plurality of female threaded apertures, each being adapted to receive a fine-tuner screw, wherein the female threaded apertures and the fine-tuner screws cooperate to engage the plurality of instrument strings in a tension-adjusting relation effected by turning the screws;

wherein said at least one clamping block is attached to said at least one clamping screw with a clip that seats in a notch in a shaft of the clamping screw so that said clamping block and screw are maintained as a unit and the clamping block moves away from the floating base plate as the clamping screw is loosened;

wherein said fine tuning plate is integral with said base plate and provides generally oblong apertures for said instrument strings to pass through said fine tuner plate and over said base plate;

wherein the device is capable of being secured to the strings between the nut or leading edge of the fret or finger board and the plurality of tuning pegs on an instrument without being secured or joined to the body or neck of the instrument.

11. The device of claim 10, wherein said floating base plate is capable of abutting a nut of a stringed instrument.

12. The device of claim 10, wherein said floating base plate further comprises a bumper that is capable of abutting a nut of a stringed instrument.

13. A tune stabilizing device for a stringed instrument having a nut, a finger or fret board, and a plurality of tuning pegs, comprising:

a floating base plate having a base compression face, and at least one female thread;

at least one clamping block having a block compression face adapted to mate with said base compression face, the clamping block including at least one unthreaded through-hole adapted to receive a screw therethrough, wherein the base and block compression faces are adapted to cooperatively engage a plurality of instrument strings;

at least one clamping screw adapted to be cooperatively received by at least one of the female threads of the floating base plate and at least one of the unthreaded through-holes of a clamping block so as to develop a compressive force between the base compression face and the block compression face, the compressive force being sufficient to fix the position of the tune-stabilizing device relative to the instrument strings; and a fine-tuner plate integral with said base plate, and having a plurality of female threaded apertures, each being adapted to receive a fine-tuner screw, wherein the female threaded apertures and the fine-tuner screws cooperate to engage the plurality of instrument strings in a tension-adjusting relation effected by turning the screws; and wherein said at least one clamping block is attached to said at least one clamping screw with a clip that seats in a notch in a shaft of the clamping screw so that said clamping block and screw are maintained as a unit and the clamping block moves away from the floating base plate as the clamping screw is loosened;

wherein said fine tuning plate has generally oblong apertures that define an arc tracking the curvature or radius of the neck of the instrument and allow said instrument strings to pass through said fine tuner plate and over said base plate; and wherein the device is capable of being secured to the strings between the nut or leading edge of the fret board and the plurality of tuning pegs on an instrument without being secured or joined to the body or neck of the instrument.

* * * * *